US006558483B2

(12) United States Patent
Nakamura et al.

(10) Patent No.: US 6,558,483 B2
(45) Date of Patent: May 6, 2003

(54) CU PRECIPITATION STRENGTHENED STEEL

(75) Inventors: Hirofumi Nakamura, Amagasaki (JP); Jun Furukawa, Kashima (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/875,146

(22) Filed: Jun. 7, 2001

(65) Prior Publication Data

US 2002/0026970 A1 Mar. 7, 2002

(30) Foreign Application Priority Data

Jun. 12, 2000 (JP) ..... 2000-175806
Jun. 12, 2000 (JP) ..... 2000-175807

(51) Int. Cl.[7] ..... C22C 38/16; C22C 38/08
(52) U.S. Cl. ..... 148/332; 148/328; 420/84; 420/92; 420/93
(58) Field of Search ..... 148/328, 332; 420/84, 92, 93

(56) References Cited

FOREIGN PATENT DOCUMENTS

| | | |
|---|---|---|
| EP | 1026275 | 8/2000 |
| JP | 62-240747 | 10/1987 |
| JP | 62-256915 | 11/1987 |
| JP | 02129317 | 5/1990 |
| JP | 04074846 | 3/1992 |
| JP | 05-163527 | 6/1993 |
| JP | 05-186823 | 7/1993 |
| JP | 10204577 | 8/1998 |
| JP | 11172368 | 6/1999 |

*Primary Examiner*—Deborah Yee
(74) *Attorney, Agent, or Firm*—Clark & Brody

(57) ABSTRACT

The Cu precipitation strengthened steel of the invention comprises, on the mass percent basis, C: 0.02–0.10%, Mn: 0.3–2.5%, Cu: 0.50–2.0%, Ni: 0.3–4.0% and Ti: 0.004–0.03% and further comprises Si: 0.01–0.4% and/or Al: 0.001–0.1%, with the contents of incidental impurities being P: not more than 0.025%, S: not more than 0.01%, N: not more than 0.006% and Se: not more than 0.005%, with the value of Pcm defined by the formula (1) given below being not more than 0.28. The steel material made of this Cu precipitation strengthened steel has good and stable CTOD toughness and is suited for use as a steel material for the construction of large industrial machines, ships, marine structures, line pipes, tanks, bridges and like welded structures.

$$Pcm = C + \frac{Si}{30} + \frac{Mn}{20} + \frac{Cu}{20} + \frac{Ni}{60} + \frac{Cr}{20} + \frac{Mo}{15} + \frac{V}{10} + 5B \quad (1)$$

In the above formula, C, Si, Mn, Cu, Ni, Cr, Mo, V and B respectively represent the contents (in mass percent) of the respective elements.

8 Claims, 2 Drawing Sheets

As rolled
580°C x 4hr.
55°C/hr.
Temp. (°C)
800
600
400
200
0
0
20000
40000
60000
80000
Time (sec)

TS (MPa)
640
620
600
580
560
540
0
20000
40000
60000
80000
Time (sec)

500°C tempered
580°C x 4hr.
55°C/hr.
Temp. (°C)
800
600
400
200
0
0
20000
40000
60000
80000
Time (sec)

TS (MPa)
640
620
600
580
560
540
0
20000
40000
60000
80000
Time (sec)

550°C tempered
580°C x 4hr.
55°C/hr.
Temp. (°C)
Time (sec)

TS (MPa)
Time (sec)

600°C tempered
580°C x 4hr.
55°C/hr.
Temp. (°C)
Time (sec)

TS (MPa)
Time (sec)

650°C tempered
580°C x 4hr.
55°C/hr.
Temp. (°C)
Time (sec)

TS (MPa)
Time (sec)

CU PRECIPITATION STRENGTHENED STEEL

BACKGROUND

1. Field of the Invention

The present invention relates to a Cu (copper) precipitation strengthened steel suited for use as a material for the construction of large industrial machines, ships, marine structures, line pipes, tanks, bridges and like welded structures, and to a method of producing the same.

2. Description of the Related Art

Recent years have seen continuous increases in the strength of welded structures, such as large industrial machines, ships, marine structures, line pipes, tanks and bridges, as requested from the viewpoint of economy and safety. To keep up with such trend, higher and higher levels of characteristics have been required of steel products to be used as materials for construction of these welded structures. One of the characteristics required of these steel products is the CTOD toughness, which is determined by the fracture toughness test according to BS 7448 or ASTM E 1290. Improvements in and stabilization of the CTOD toughness greatly contribute to the improvement in the safety of welded structures.

The "CTOD toughness" is an indicator of the resistance to CTOD (Crack Tip Opening Displacement). More specifically, a test specimen given a fatigue crack is subjected to three point bending at a given temperature and the opening displacement at the crack tip is measured with a clip gage or the like. The CTOD toughness is evaluated in terms of the critical value of crack tip opening displacement at the time of fracture (hereinafter referred to as "critical CTOD value").

It is known in the art that it is effective in improving the CTOD toughness of steel products to reduce the C content in the steel. To compensate for the decrease in strength as resulting from the reduction in C content in steel, various alloying elements are added and/or the production process is modified to increase the strength. Thus, for example, steel products which utilize Cu precipitation hardening are disclosed in ASTM A 710 and U.S. Pat. No. 3,692,514. These steel products are characterized by their being excellent in weldability. Improvements in their toughness in low temperature environments are still desired, however.

While the CTOD toughness is evaluated by using a plurality of test specimens collected from one steel product and carrying out a plurality of test runs under the same conditions, some test specimens may show markedly lower critical CTOD values as compared with other test specimens in certain instances even when they are tested under the same conditions. The CTOD toughness required of steel products is evaluated in terms of the lowest critical CTOD value (hereinafter referred to as "minimum critical CTOD value") among the critical CTOD values of those test specimens tested under the same conditions and, therefore, it is necessary that the minimum critical CTOD value for a steel product should clear a given value. Therefore, in the art, the C content in steel is reduced to an excessive extent or expensive alloying elements are added in large amounts to thereby excessively improve the CTOD toughness in preparation for the phenomenon mentioned above. As a result, it has been difficult to reduce the cost of production of Cu precipitation strengthened steels.

SUMMARY

Accordingly, it is an object of the present invention to provide a Cu precipitation strengthened steel having good and stable CTOD toughness as well as a method of producing the same.

The Cu precipitation strengthened steel of the invention comprises, on the mass percent basis, C: 0.02–0.10%, Mn: 0.3–2.5%, Cu: 0.50–2.0%, Ni: 0.3–4.0% and Ti: 0.004–0.03% and further comprises Si: 0.01–0.4% and/or Al: 0.001–0.1%, with the contents of incidental impurities being P: not more than 0.025%, S: not more than 0.01%, N: not more than 0.006% and Se: not more than 0.005%, with the value of Pcm defined by the formula (1) given below being not more than 0.28:

$$Pcm = C + \frac{Si}{30} + \frac{Mn}{20} + \frac{Cu}{20} + \frac{Ni}{60} + \frac{Cr}{20} + \frac{Mo}{15} + \frac{V}{10} + 5B \quad (1)$$

where C, Si, Mn, Cu, Ni, Cr, Mo, V and B respectively represent the contents (in mass percent) of the respective elements.

The strength can further be improved by causing the steel to contain, on the mass percent basis, at least one element selected from the group consisting of Cr: 0.05–1.0%, Mo: 0.05–1.0%, Nb: 0.005–0.04%, V: 0.01–0.10% and B: 0.0005–0.003%.

The toughness can further be improved by causing the steel to contain, on the mass percent basis, at least one element selected from the group consisting of Ca: 0.0005–0.05%, Zr: 0.0005–0.05% and REMs (rare earth metals): 0.0005–0.05%.

The steel of the present invention can be produced by a production process comprising the following steps (a) to (e), which is given as an embodiment of the present invention:

Step (a): Heating a steel having the above chemical composition to a temperature not lower than 950° C. but not higher than 1250° C.;

Step (b): Hot rolling the thus-heated steel;

Step (c): Allowing the hot-rolled steel to cool or cooling the same in an accelerated manner;

Step (d): Reheating the steel after being allowed to cool or acceleratedly cooled to a temperature not lower than 450° C. but not higher than 680° C.; and Step (e): Air cooling the reheated steel.

When it is intended that the stability of welded structures in which the steel product of the invention is applied as a material for constructing them be improved, the steel can also be produced by another embodiment of the production process of the present invention which comprises the following steps (A) to (C):

Step (A): Estimating, for a steel having the above chemical composition, the change in tensile strength in the process of strain-removing heat treatment on the assumption that the steel may be subjected to strain-removing heat treatment after tempering under various conditions;

Step (B): Determining the tempering conditions based on the change in tensile strength as estimated in step (A); and Step (C): Tempering the steel under the tempering conditions established in step (B).

BRIEF DESCRIPTION OF THE DRAWINGS

FIG. 1(*b*) is a graphic representation of the results of calculations for estimating the change in tensile strength at ordinary temperature as made for the same Cu-containing steel after application of the heating pattern shown in FIG. 1(*a*).

FIG. 2(*b*) is a graphic representation of the results of calculations for estimating the change in tensile strength at ordinary temperature as made for the same Cu-containing steel after application of the heating pattern shown in FIG. 2(*a*).

FIG. 3(*b*) is a graphic representation of the results of calculations for estimating the change in tensile strength at ordinary temperature as made for the same Cu-containing steel after application of the heating pattern shown in FIG. 3(*a*).

FIG. 4(*b*) is a graphic representation of the results of calculations for estimating the change in tensile strength at ordinary temperature as made for the same Cu-containing steel after application of the heating pattern shown in FIG. 4(*a*).

FIG. 5(*b*) is a graphic representation of the results of calculations for estimating the change in tensile strength at ordinary temperature as made for the same Cu-containing steel after application of the heating pattern shown in FIG. 5(*a*).

DETAILED DESCRIPTION OF THE INVENTION

Figures 1A, 1B, 2A, 2B:
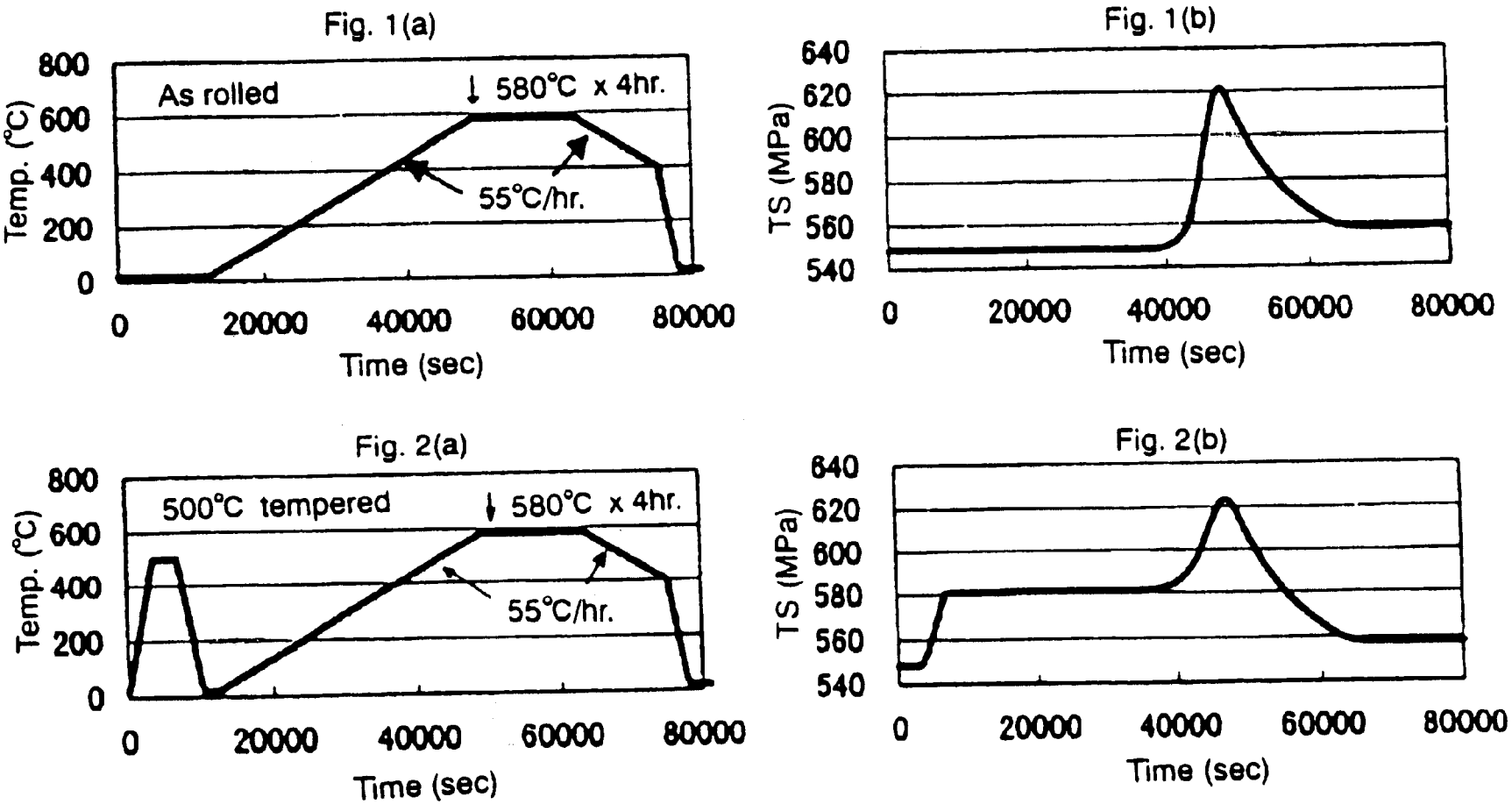
FIG. 1(*a*) is a graphic representation of a heating pattern to be followed on the assumption that a Cu-containing steel as rolled is subjected to strain-removing heat treatment.
FIG. 2(*a*) is a graphic representation of a heating pattern to be followed on the assumption that a Cu-containing steel is subjected to tempering at 500° C. for 1 hour and strain-removing heat treatment.

The steel of the present invention is a Cu precipitation strengthened steel stabilized in CTOD toughness by reducing the content of Se, which is an incidental impurity, to 0.005% or below to thereby inhibit the formation of inclusions of Se, based on the finding, obtained upon investigation concerning the phenomenon of markedly low critical CTOD values being sometimes found in the CTOD test, that this phenomenon is caused by inclusions of the incidental impurity Se.

In the following, the Cu precipitation strengthened steel of the present invention and the method of producing the same are more specifically described. In the following description, the percentage indicating the content of each chemical constituent means "% by mass".

Chemical Composition of the Steel:

C: 0.02–0.10%

C is an element contributing toward increasing the strength. At a level below 0.02%, the strength can hardly be secured. On the other hand, at a content exceeding 0.10%, it deteriorates the desired weldability and toughness of the product. Hence, the C content should be not less than 0.02% but not more than 0.10%. From the economy and high performance viewpoint, the C content is desirably not less than 0.03% but not more than 0.08%.

Mn: 0.3–2.5%

Mn is an element necessary for securing the strength and toughness of steel. At a level lower than 0.3%, such effects are slight while addition thereof at a high level exceeding 2.5% results in deterioration of the weldability. Hence the Mn content should be not less than 0.3% but not more than 2.5%. From the economy and high performance viewpoint, the Mn content is desirably not less than 0.6% but not more than 1.8%.

Cu: 0.5–2.0%

Cu is an element characterizing the present invention. By utilizing the Cu precipitation hardening, the C content can be reduced and thereby the weldability and toughness of steel can be improved. For attaining effective Cu precipitation hardening, the Cu content should be not less than 0.5%. On the other hand, an excess Cu content conversely results in decreases in toughness of steel and at the same time impairs the hot workability of steel. Therefore, the Cu content should be not higher than 2.0%. From the economy and high performance viewpoint, the Cu content is desirably not less than 0.7% but not more than 1.8%.

Ni: 0.3–4.0%

Ni is effective in preventing the occurrence of cracks in the step of hot working, which is the phenomenon intrinsic in Cu-containing steels, to thereby improve the workability. It is also effective in improving the strength of steel. For efficiently achieving these effects, the Ni content should be not less than 0.3%. For suppressing the above-mentioned cracking in the step of hot working, it is desirable that Ni be contained at a level not lower than half the Cu content. On the other hand, at an excessive Ni content, scale defects tend to appear. For avoiding this, the Ni content should be not more than 4.0%. Since Ni is an expensive element, the Ni content is desirably not more than 2.0% from the economy viewpoint.

Ti: 0.004–0.03%

Ti is an element capable of fixating solute-form N, which impairs the toughness of steel, and rendering the same harmless and at the same time effective in inhibiting austenite grains from coarsening to thereby improve the toughness of steel. For obtaining this effect, the Ti content should be not less than 0.004%. On the other hand, an excessive Ti content conversely brings about decreases in toughness of steel. Since, according to the present invention, the N content should be not more than 0.006%, as mentioned later herein, the Ti content should be not more than 0.03% in proportion to the N content. From the high performance viewpoint, the Ti content is desirably not less than 0.005% but not more than 0.015%.

Si: 0.01–0.4%, Al: 0.001–0.1%

Si and Al both deoxidize steel and are thus effective in rendering the steel sound. At excessive levels, however, they deteriorate the toughness and weldability of steel. Therefore, one or both of them are caused to be contained, Si within the content range of not less than 0.01% but not more than 0.4% and Al within the content range of not less than 0.001% but not more than 0.1%. From the economy and high performance viewpoint, the Si content is desirably within the range of not less than 0.01% but not more than 0.2% and the Al content is desirably within the range of not less than 0.001% but not more than 0.04%. Si is also effective in increasing the strength of steel and, when it is contained in the above range, this effect can also be produced.

P: not more than 0.025%, S: not more than 0.01%, N: not more than 0.006%

P, S and N, which are incidental impurities, markedly reduce the toughness of steel. Therefore, it is desirable to reduce the P, S and N contents to levels as low as possible.

To markedly reduce the contents of these elements, however, proportional costs are required. Therefore, in accordance with the invention, the P content is restricted to 0.025% or less, the S content to 0.01% or less and, the N content to 0.006% or less.

Se: not more than 0.005%

Se, which is an incidental impurity, forms hard and brittle inclusions in steel and thereby markedly decreases the CTOD toughness of steel. Therefore, the Se content should be not more than 0.005%. For the higher performance viewpoint, the Se content is desirably not more than 0.001%.

Cr: 0.05–1.0%, Mo: 0.05–1.0%, Nb: 0.005–0.04%, V: 0.01–0.10% and B: 0.0005–0.003%

Cr, Mo, Nb, V and B are all effective in increasing the strength of steel and can be contained to produce such effect. However, excessive contents thereof deteriorate the toughness and weldability. Thus, in cases where they are caused to be contained in the steel, one or more members of the group consisting of these elements are caused to be contained desirably within the content range of not less than 0.05% but not more than 1.0% in the case of Cr, not less than 0.05% but not more than 1.0% in the case of Mo, not less than 0.005% but not more than 0.04% in the case of Nb, not less than 0.01% but not more than 0.10% in the case of V, and not less than 0.0005% but not more than 0.003% in the case of B. For obtaining higher performance characteristics, the preferred content ranges for the respective elements are as follows: Cr: 0.1–0.3%, Mo: 0.1–0.3%, Nb: 0.005–0.02%, V: 0.01–0.05%, and B: 0.0005–0.002%.

Ca: 0.0005–0.05%, Zr: 0.0005–0.05%, REMs: 0.0005–0.05%

Ca, Zr and REMs are effective in controlling the yield and morphology of inclusions in steel and thus improving the toughness. Therefore, these may be caused to be contained in the steel for producing this effect. However, excessive contents thereof may rather impair the toughness in certain instances. If these are caused to be contained, therefore, one or more of them are caused to be contained desirably within the content range of not less than 0.0005% but not more than 0.05% in the case of Ca, not less than 0.0005% but not more than 0.05% in the case of Zr, and not less than 0.0005% but not more than 0.05% in the case of REMs.

Other Elements

Those other elements than the elements mentioned above which are generally added in steel production may be added without any particular restriction unless they weaken or nullify the effects of the invention.

Pcm: not more than 0.28

Pcm is an indicator of susceptibility to weld cracking. When the value of Pcm defined by the formula (1) given above is not more than 0.28, no weld cracking occurs under ordinary welding conditions. Therefore, the value of Pcm should be not more than 0.28. Since when the Pcm value is lower, the step of preheating can be omitted in carrying out welding, the Pcm value is desirably as small as possible.

When the steel contains B, the steel acquires an increased level of hardenability. It is therefore desirable that the Pcm value be restricted according to the B content. For example, when the B content is less than 0.0003%, it is desirable that the Pcm value be not more than 0.21 and, when the B content is not lower than 0.0003%, the Pcm value is desirably not more than 0.19. By restricting the Pcm value in that manner, it becomes possible to obtain good welding results even when the welding is carried out under ordinary conditions without preheating under environmental conditions of 25° C.

Steel Production Method 1:

The steel of the present invention can be produced by a production process comprising the following steps (a) to (e), which is given as an embodiment of the present invention:

Step (a): Heating a steel having the above chemical composition to a temperature not lower than 950° C. but not higher than 1250° C.;

Step (b): Hot rolling the thus-heated steel;

Step (c): Allowing the hot-rolled steel to cool or cooling the same in an accelerated manner;

Step (d): Reheating the steel after being allowed to cool or acceleratedly cooled to a temperature not lower than 450° C. but not higher than 680° C.; and Step (e): Air cooling the reheated steel.

In the following, the above steps (a) to (e) are described in detail.

Step (a)

A steel having the above chemical composition is heated to a temperature not lower than 950° C. but not higher than 1250° C. At a heating temperature below 950° C., it may become difficult in some instances to secure the required finishing temperature in the next hot rolling step (b). At a heating temperature above 1250° C., on the other hand, austenite grains coarsen and the toughness of the product decreases.

Therefore, in the above embodiment of the invention, a heating temperature of not lower than 950° C. but not higher than 1250° C. is employed for the heating of steel prior to hot rolling.

Step (b)

The hot rolling conditions may be the same as those used in producing conventional steel products.

Step (c)

The steel after completion of the hot rolling is allowed to cool or acceleratedly cooled.

When, in this step, the cooling (allowing to cool or acceleratedly cooling) is carried out at a cooling rate of not slower than 1° C./sec, the formation of a bainite structure containing coarse carbides can be suppressed and the strength can be increased to a satisfactory level even in the core of the steel product. Therefore, when the desired strength of the steel product is at a high level, it is desirable in the above embodiment of the invention to employ a cooling rate of not slower than 1° C./sec in allowing the steel to cool or cooling the same acceleratedly.

On the other hand, when the cooling rate is in excess of 50° C./sec in allowing the steel to cool or cooling the same acceleratedly, the vicinity of the surface layer of the steel product may readily be quenched, so that the toughness of the surface layer of the steel product decreases in some instances. Therefore, in the above embodiment of the invention, it is desirable that the cooling rate in allowing the steel to cool or cooling the same acceleratedly be not more than 50° C./sec.

Further, when the cooling is finished at a temperature above 580° C., the formation of martensite or lower bainite or the like becomes insufficient not only in the core but also in the surface layer of the steel and it becomes difficult in certain instances to secure the desired strength. Therefore, when a high level of strength is required of the steel in the above embodiment of the invention, it is desirable to finish the allowing to cool or cooling acceleratedly at a temperature not higher than 580° C.

Step (d) and Step (e)

The steel cooled in step (c) is reheated to a temperature not lower than 450° C. but not higher than 680° C. and then air-cooled. This is for the purpose of efficiently and stably attaining Cu precipitation hardening. According to the desired strength and/or toughness, the reheating temperature is selected within the range of 450–680° C.

When, in step (d), the reheating temperature is lower than 450° C., the precipitation of Cu will not be fully finished. Therefore, in cases where the intended steel strength is high, there arises the possibility of such steel strength being not satisfactorily secured. At a reheating temperature higher than 680° C., the steel strength cannot be secured any longer due to over aging.

Therefore, in the above embodiment of the invention, the reheating temperature should be not lower than 450° C. but lower than 680° C.

Steel Production Method 2:

The steel of the invention can also be produced by another process, which is another embodiment of the production process of the present invention and which comprises the following steps (A) to (C):

Step (A): Estimating, for a steel having the above chemical composition, the change in tensile strength in the process of strain-removing heat treatment on the assumption that the steel may be subjected to strain-removing heat treatment after tempering under various conditions;

Step (B): Determining the tempering conditions based on the change in tensile strength as estimated in step (A); and Step (C): Tempering the steel under the tempering conditions established in step (B).

In the following, the above steps (A) to (C) are described in detail.

Step (A)

For a steel having the above chemical composition, the change in tensile strength in the process of strain-removing heat treatment is estimated on the assumption that the steel may be subjected to strain-removing heat treatment after tempering under various conditions The tensile strength of a Cu precipitation strengthened steel varies in the process of strain-removing heat treatment thereof mainly due to the change in the state of precipitation of Cu upon strain-removing heat treatment and to the change in the matrix of steel and, therefore, can be calculated as a function of the strain-removing heat treatment temperature and the time.

Therefore, the estimation of the change in tensile strength in the process of strain-removing heat treatment is desirably carried out based on the estimation of Cu precipitation hardening in the process of strain-removing heat treatment, of Cu over age softening, and of temper softening of the steel matrix. In this case, in estimating the change in tensile strength in the process of strain-removing heat treatment, it is desirable to use a predictive equation involving the terms corresponding to Cu precipitation hardening in the process of strain-removing heat treatment, Cu over age softening and temper softening of the steel matrix. The following equations (2) and (3), for instance, may be used as the above predictive equation.

$$\sigma = M[B - \exp(-P_1^{1.5}) + \exp(-P_2) + C\exp(-P_3)] \quad (2)$$

$$P_m = \sum_i A_m \exp\left(-\frac{Q_m}{RT_i}\right) \cdot \Delta t_i \quad (3)$$

$$m = 1, 2, 3$$

In the above equations, σ is the tensile strength (MPa), R is the gas constant, $\Delta t_i$ is each very short time interval, $T_i$ is the steel temperature (K) in that very short time interval.

$A_1$, $A_2$, $A_3$, $Q_1$, $Q_2$, $Q_3$, M, B and C are constants determined by the chemical composition of steel and the production conditions, and can be empirically determined by actually performing heat treatment of the Cu-containing steel in question under various conditions and measuring the tensile strength.

In carrying out the tensile strength estimation using the equations (2) and (3), the temperature change in the process of strain-removing heat treatment is approximated by a stairlike function, and the heat treatment time is divided into very short time intervals (e.g. 1 second) so that the steel temperature change during the interval may amount to not more than 10° C. and the i–th interval is represented by $\Delta t_i$. When the steel temperature (absolute temperature) in the i–th time interval is represented by $T_i$ (K), the gas constant by R, the activation energy by $Q_m$ and the oscillation factor term by $A_m$, the reaction rate constant is represented by $A_m\exp(-Q_m/RT_i)$.

Here, $Q_1$ is the activation energy for Cu precipitation, $P_1^{1.5}$ is the degree of progress of age hardening, and $-\exp(-P_1^{1.5})$ is a term expressing the contribution of Cu precipitation to the tensile strength.

$Q_2$ is the activation energy for coarsening of Cu precipitate particles, $P_2$ is the degree of progress of over age softening due to coarsening of Cu particles, and $\exp(-P_2)$ is a term expressing the softening in tensile strength due to coarsening of Cu precipitate particles.

$Q_3$ is the activation energy relative to temper softening of the steel matrix, $P_3$ is the degree of progress of softening due to tempering of the steel matrix, and $C\exp(-P_3)$ is a term expressing the temper softening of the steel matrix.

While the constants appearing in the equations (2) and (3) may vary depending on the chemical composition of the steel and the conditions of hot rolling and of the subsequent cooling, among others, the following values may be used, for example for a steel whose Cu content is about 1% and whose tensile strength is about 480–650 MPa: $Q_1$=140 kJ/mol, $Q_2$=244 kJ/mol, $Q_3$=285 kJ/mol, $A_1=5\times10^5$, $A_2=1\times10^{11}$, $A_3=5\times10^{11}$, M=82.5 MPa, B=5.65, and C=1.

The anticipated strain-removing heat treatment may be a typical heat treatment employed following welding and, for example, the following strain-removing heat treatment conditions including the three steps (I) to (IV) may be considered:

Step (I): Heating the steel from ordinary temperature to 580° C. at a heating rate of 55° C./hour;

Step (II): Maintaining the steel at 580° C. for 4 hours;

Step (III): Cooling the steel from 580° C. to 400° C. at a cooling rate of 55° C./hour; and Step (IV): Cooling the steel to room temperature at an arbitrary cooling rate.

The estimation of the change in tensile strength in the process of strain-removing heat treatment according to the equations (2) and (3) is recommendably carried out in the following manner. First, the equations (2) and (3) are stored in a computer. Then, various tempering and strain-removing heat treatment conditions are inputted into the computer. Then, for the cases where the various tempering and strain-removing heat treatment conditions are applied, the change in tensile strength at ordinary temperature is calculated by the computer at each time point during the period from the start of tempering to the completion of strain-removing heat treatment.

FIG. 1(*a*) is a graphic representation of a heating pattern to be followed on the assumption that a Cu-containing steel as rolled is subjected to strain-removing heat treatment. FIG. 1(*b*) is a graphic representation of the results of calculations for estimating the change in tensile strength at ordinary temperature as made for the same Cu-containing steel after application of the heating pattern shown in FIG. 1(*a*)

As shown by the graph in FIG. 1(*b*), the product as rolled has a tensile strength of 549 MPa. At about 10 hours after the start of the strain-removing heat treatment, the tensile strength is increased to 622 MPa. Then, softening occurs due to over aging and, at the time of finishing of the strain-removing heat treatment, the tensile strength becomes 558 MPa. As a result, the change in tensile strength within the range of 549–622 MPa occurs in the vicinity of that site or section subjected to the above strain-removing heat treatment.

FIG. 2(*a*) is a graphic representation of a heating pattern to be followed on the assumption that a Cu-containing steel is subjected to tempering at 500° C. for 1 hour and strain-removing heat treatment. FIG. 2(*b*) is a graphic representation of the results of calculations for estimating the change in tensile strength at ordinary temperature as made for the same Cu-containing steel after application of the heating pattern shown in FIG. 2(*a*).

As shown by the graph in FIG. 2(*b*), tempering raises the tensile strength to 581 MPa and, at about 10 hours after the start of the above strain-removing heat treatment, the tensile strength rises to 624 MPa, then softening occurs due to over aging and, at the time of completion of the strain-removing heat treatment, the tensile strength becomes 558 MPa. As a result, the change in tensile strength within the range of 558–624 MPa occurs in the vicinity of that section subjected to the above strain-removing heat treatment.

Figures 3A, 3B, 4A, 4B, 5A, 5B:
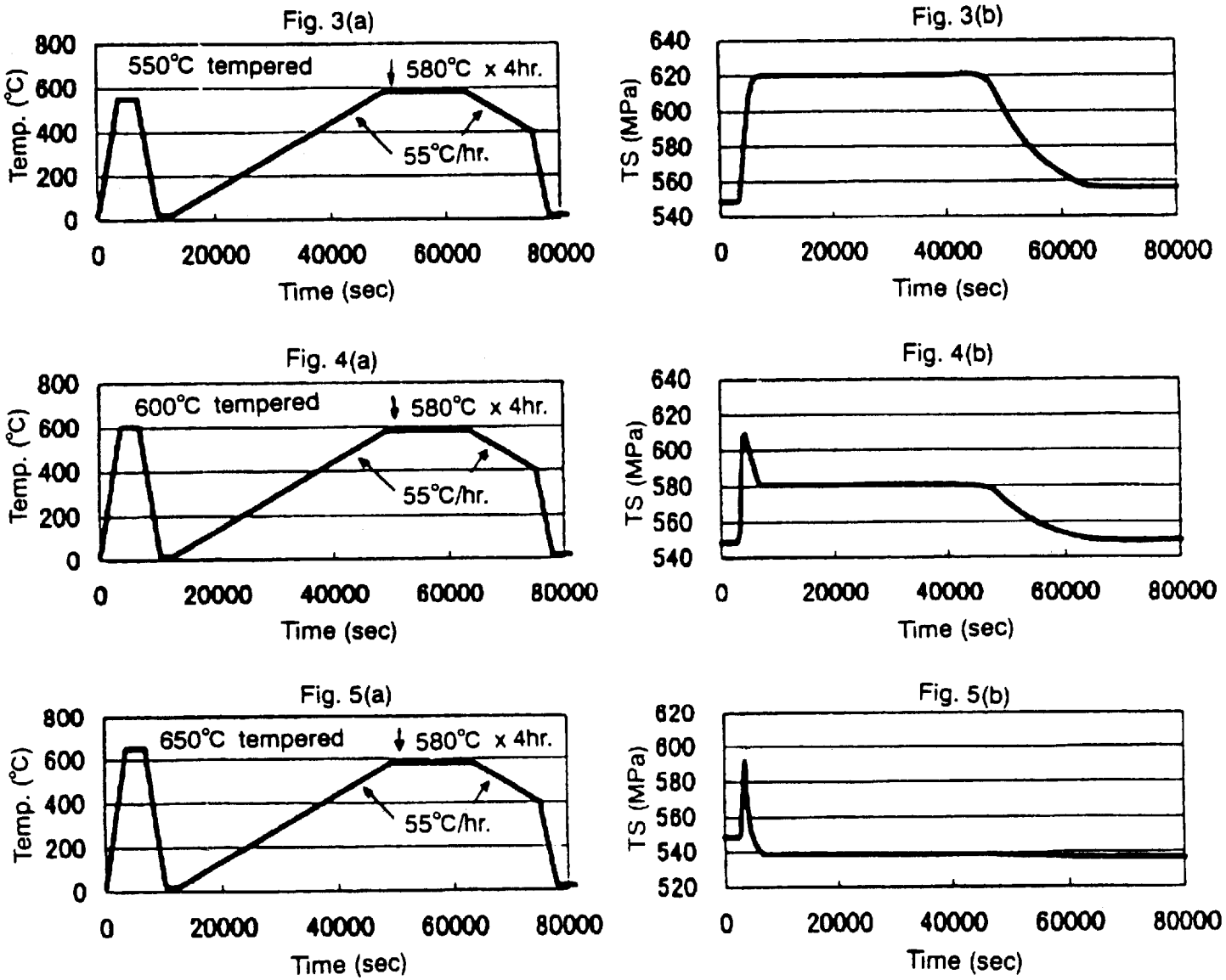
FIG. 3(*a*) is a graphic representation of a heating pattern to be followed on the assumption that a Cu-containing steel is subjected to tempering at 550° C. for 1 hour and strain-removing heat treatment.
FIG. 4(*a*) is a graphic representation of a heating pattern to be followed on the assumption that a Cu-containing steel is subjected to tempering at 600° C. for 1 hour and strain-removing heat treatment.
FIG. 5(*a*) is a graphic representation of a heating pattern to be followed on the assumption that a Cu-containing steel is subjected to tempering at 650° C. for 1 hour and strain-removing heat treatment.

FIG. 3(*a*) is a graphic representation of a heating pattern to be followed on the assumption that a Cu-containing steel is subjected to tempering at 550° C. for 1 hour and strain-removing heat treatment. FIG. 3(*b*) is a graphic representation of the results of calculations for estimating the change in tensile strength at ordinary temperature as made for the same Cu-containing steel after application of the heating pattern shown in FIG. 3(*a*).

As shown by the graph in FIG. 3(*b*), the tensile strength at the time of finishing of tempering is 620 MPa and, at the time of finishing of the strain-removing heat treatment, the tensile strength becomes 556 MPa. As a result, the change in tensile strength within the range of 556–620 MPa occurs in the vicinity of that section subjected to the above strain-removing heat treatment.

FIG. 4(*a*) is a graphic representation of a heating pattern to be followed on the assumption that a Cu-containing steel is subjected to tempering at 600° C. for 1 hour and strain-removing heat treatment. FIG. 4(*b*) is a graphic representation of the results of calculations for estimating the change in tensile strength at ordinary temperature as made for the same Cu-containing steel after application of the heating pattern shown in FIG. 4(*a*).

As shown by the graph in FIG. 4(*b*), the tensile strength at the time of finishing of tempering is 581 MPa and, at the time of finishing of the strain-removing heat treatment, the tensile strength becomes 550 MPa. As a result, the change in tensile strength within the range of 550–581 MPa occurs in the vicinity of that section subjected to the above strain-removing heat treatment.

FIG. 5(*a*) is a graphic representation of a heating pattern to be followed on the assumption that a Cu-containing steel is subjected to tempering at 650° C for 1 hour and strain-removing heat treatment. FIG. 5(*b*) is a graphic representation of the results of calculations for estimating the change in tensile strength at ordinary temperature as made for the same Cu-containing steel after application of the heating pattern shown in FIG. 5(*a*).

As shown by the graph in FIG. 5(*b*), the change in tensile strength within the range of 536–539 MPa occurs in the vicinity of that section subjected to the above strain-removing heat treatment.

Steps (B) and (C)

Based on the change in tensile strength in the strain-removing heat treatment as estimated in step (A), the tempering conditions are established and the steel is tempered under the tempering conditions established.

In the above mode of embodiment of the present invention, it is intended that when the steel of the invention is used as a material for constructing a welded structure, the stability of the welded structure be improved by reducing the change in steel material strength as caused by strain-removing heat treatment following welding.

Therefore, it is desirable to determine the tempering conditions so that the change in tensile strength as estimated in step (A) may be not more than 50 MPa. The reason why the tempering conditions are determined based on the change in tensile strength in the process of strain-removing heat treatment, not on the change in tensile strength between the value before and the value after the strain-removing heat treatment is as follows.

From the welded structure stability viewpoint, not only the change in tensile strength in the section subjected to strain-removing heat treatment but also the change in tensile strength at sites away from the section subjected to strain-removing heat treatment is to be taken into consideration. The sites away from the section subjected to strain-removing heat treatment undergo shorter periods of heat treatment at lower temperatures as compared with the section subjected to strain-removing heat treatment, so that the mechanical characteristics of those sites correspond to the mechanical characteristics which the section subjected to strain-removing heat treatment shows during the heat treatment. Therefore, it is necessary to determine the tempering conditions based not only on the change in tensile strength between the value before and the value after strain-removing heat treatment but also on the change in tensile strength in the process of strain-removing heat treatment.

Here, the tempering conditions may be arbitrary ones provided that the desired strength can be secured thereunder. Generally, the heating rate is 400–2000° C./hour, the heating temperature is 400–700° C., and the cooling rate is 100–10000° C./hour, for instance.

Embodiments

First Embodiment

Cu precipitation strengthened steel plates were produced according to the chemical composition and production conditions specified in Table 1, and test specimens were cut out of the steel plates and measured for YS, TS, and critical CTOD value. The CTOD test was performed according to the method of BS 7448; the test temperature was −40° C.

The results are summarized in Table 1.

TABLE 1

| Test | Chemical composition (mass %: Fe and other incidental impurities) | | | | | | | | | | | | |
|---|---|---|---|---|---|---|---|---|---|---|---|---|---|
| No. | C | Si | Mn | P | S | Cu | Ni | Nb | Ti | Se | Al | N | Pcm |
| 1 | 0.06 | 0.19 | 1.3 | 0.013 | 0.006 | 1.05 | 0.5 | 0.01 | 0.012 | 0.001 | 0.01 | 0.004 | 0.19 |
| 2 | 0.06 | 0.19 | 1.5 | 0.011 | 0.006 | 1.05 | 0.5 | 0.01 | 0.012 | 0.001 | 0.01 | 0.004 | 0.20 |
| 3 | 0.05 | 0.19 | 1.4 | 0.012 | 0.006 | 1.05 | 0.3 | 0.01 | 0.012 | 0.001 | 0.01 | 0.004 | 0.18 |
| 4 | 0.05 | 0.18 | 1.4 | 0.012 | 0.006 | 1.05 | 0.4 | 0.01 | 0.012 | 0.001 | 0.01 | 0.004 | 0.19 |
| 5 | 0.02 | 0.18 | 2.0 | 0.012 | 0.006 | 1.05 | 0.7 | 0.02 | 0.012 | 0.001 | 0.01 | 0.004 | 0.19 |
| 6 | 0.10 | 0.06 | 1.0 | 0.012 | 0.006 | 1.05 | 0.4 | 0.01 | 0.012 | 0.001 | 0.01 | 0.004 | 0.21 |
| 7 | 0.04 | 0.06 | 1.6 | 0.012 | 0.006 | 1.05 | 0.4 | 0.01 | 0.012 | 0.001 | 0.01 | 0.004 | 0.18 |
| 8 | 0.07 | 0.07 | 0.05 | 0.012 | 0.006 | 1.05 | 0.4 | 0.01 | 0.012 | 0.001 | 0.01 | 0.004 | 0.16 |
| 9 | 0.05 | 0.06 | 1.4 | 0.025 | 0.006 | 1.05 | 0.4 | 0.01 | 0.012 | 0.001 | 0.01 | 0.004 | 0.18 |
| 10 | 0.05 | 0.06 | 1.4 | 0.013 | 0.01 | 1.05 | 0.4 | 0.01 | 0.012 | 0.001 | 0.01 | 0.004 | 0.18 |
| 11 | 0.08 | 0.12 | 1.2 | 0.013 | 0.006 | 0.50 | 0.4 | 0.01 | 0.012 | 0.001 | 0.01 | 0.003 | 0.18 |
| 12 | 0.05 | 0.11 | 1.2 | 0.013 | 0.006 | 2.00 | 0.4 | 0.01 | 0.012 | 0.001 | 0.01 | 0.003 | 0.22 |
| 13 | 0.05 | 0.11 | 1.4 | 0.013 | 0.006 | 1.05 | 3.5 | 0.01 | 0.012 | 0.001 | 0.01 | 0.003 | 0.23 |
| 14 | 0.05 | 0.11 | 1.4 | 0.013 | 0.006 | 1.05 | 0.4 | 0.005 | 0.012 | 0.001 | 0.01 | 0.003 | 0.18 |
| 15 | 0.05 | 0.11 | 1.4 | 0.013 | 0.006 | 1.05 | 0.4 | 0.02 | 0.005 | 0.001 | 0.01 | 0.003 | 0.18 |
| 16 | 0.05 | 0.11 | 1.4 | 0.013 | 0.006 | 1.05 | 0.4 | 0.01 | 0.012 | 0.001 | 0.01 | 0.003 | 0.18 |
| 17 | 0.05 | 0.12 | 1.5 | 0.013 | 0.006 | 1.05 | 0.4 | 0.01 | 0.012 | 0.001 | 0.01 | 0.003 | 0.19 |
| 18 | 0.05 | 0.11 | 1.4 | 0.013 | 0.006 | 1.05 | 0.4 | 0.01 | 0.012 | 0.005 | 0.01 | 0.003 | 0.18 |
| 19 | 0.09 | 0.12 | 1.5 | 0.017 | 0.007 | 1.01 | 0.5 | 0.01 | 0.012 | 0.002 | 0.01 | 0.003 | 0.23 |
| 20 | 0.05 | 0.11 | 1.4 | 0.012 | 0.007 | 1.01 | 0.5 | 0.01 | 0.012 | 0.002 | 0.01 | 0.003 | 0.18 |
| 21 | 0.05 | 0.11 | 1.4 | 0.012 | 0.007 | 1.01 | 0.5 | 0.01 | 0.012 | 0.002 | 0.01 | 0.003 | 0.18 |
| 22 | 0.03 | 0.12 | 0.8 | 0.015 | 0.006 | 0.50 | 0.5 | 0.005 | 0.012 | 0.002 | 0.01 | 0.003 | 0.11 |
| 23 | 0.05 | 0.11 | 1.4 | 0.012 | 0.005 | 1.00 | 0.5 | 0.01 | 0.012 | 0.002 | 0.01 | 0.003 | 0.18 |
| 24 | 0.01 | 0.12 | 1.5 | 0.012 | 0.007 | 1.01 | 0.5 | 0.01 | 0.012 | 0.002 | 0.01 | 0.003 | 0.15 |
| 25 | 0.12 | 0.11 | 1.0 | 0.012 | 0.007 | 1.01 | 0.5 | 0.01 | 0.012 | 0.002 | 0.01 | 0.003 | 0.23 |
| 26 | 0.05 | 0.11 | 1.4 | 0.03 | 0.007 | 1.01 | 0.5 | 0.01 | 0.012 | 0.002 | 0.01 | 0.003 | 0.18 |
| 27 | 0.05 | 0.11 | 1.4 | 0.012 | 0.02 | 1.01 | 0.5 | 0.01 | 0.012 | 0.002 | 0.01 | 0.003 | 0.18 |
| 28 | 0.08 | 0.11 | 1.2 | 0.012 | 0.008 | 0.40 | 0.5 | 0.01 | 0.012 | 0.002 | 0.01 | 0.003 | 0.17 |
| 29 | 0.08 | 0.12 | 1.7 | 0.021 | 0.009 | 2.35 | 0 | 0.03 | 0.012 | 0.003 | 0.008 | 0.003 | 0.29 |
| 30 | 0.04 | 0.12 | 1.1 | 0.012 | 0.005 | 0.80 | 0.5 | 0.003 | 0.08 | 0.002 | 0.007 | 0.003 | 0.15 |
| 31 | 0.08 | 0.11 | 1.8 | 0.018 | 0.008 | 1.70 | 0.2 | 0.05 | 0.012 | 0.004 | 0.2 | 0.003 | 0.26 |
| 32 | 0.08 | 0.11 | 1.6 | 0.02 | 0.008 | 1.15 | 0.5 | 0.06 | 0.012 | 0.006 | 0.014 | 0.003 | 0.23 |

| | Production conditions | | | | Product characteristics | | |
|---|---|---|---|---|---|---|---|
| Test No. | Heating temp. (° C.) | Cooling rate (° C./sec) | Cooling finish temp. (° C.) | Reheating temp. (° C.) | YS (MPa) | TS (MPa) | Minimum critical CTOD value (mm) |
| 1 | 1250 | Allowed to cool | Allowed to cool | 600 | 590 | 680 | 1.25 |
| 2 | 950 | Allowed to cool | Allowed to cool | 600 | 572 | 660 | 1.41 |
| 3 | 1050 | 15 | 580 | 600 | 569 | 639 | 1.34 |
| 4 | 1050 | 50 | 550 | 600 | 560 | 682 | 1.35 |
| 5 | 1050 | 18 | 550 | 600 | 571 | 660 | 1.42 |
| 6 | 1050 | 16 | 550 | 600 | 585 | 669 | 1.32 |
| 7 | 1050 | 15 | 550 | 600 | 570 | 650 | 1.32 |
| 8 | 1050 | 18 | 550 | 600 | 563 | 651 | 1.32 |
| 9 | 1050 | 15 | 550 | 600 | 555 | 644 | 1.34 |
| 10 | 1050 | 18 | 550 | 600 | 559 | 651 | 1.33 |
| 11 | 1050 | 15 | 550 | 600 | 555 | 654 | 1.41 |
| 12 | 1050 | 16 | 550 | 600 | 587 | 673 | 1.33 |
| 13 | 1050 | 15 | 550 | 600 | 570 | 650 | 1.43 |
| 14 | 1050 | 18 | 550 | 600 | 568 | 649 | 1.32 |
| 15 | 1050 | 18 | 550 | 600 | 570 | 650 | 1.32 |
| 16 | 1050 | 15 | 550 | 450 | 590 | 672 | 1.28 |
| 17 | 1050 | 15 | 550 | 680 | 559 | 645 | 1.43 |
| 18 | 1050 | 15 | 550 | 600 | 559 | 645 | 0.82 |
| 19 | 1300 | Allowed to cool | Allowed to cool | 580 | 590 | 690 | 0.76 |
| 20 | 900 | Allowed to cool | Allowed to cool | 500 | 530 | 605 | 1.21 |
| 21 | 1100 | 18 | 620 | 580 | 530 | 645 | 0.75 |
| 22 | 1240 | 12 | 570 | 400 | 532 | 625 | 0.73 |
| 23 | 950 | 15 | 560 | 700 | 515 | 609 | 1.23 |
| 24 | 1050 | 15 | 550 | 580 | 533 | 620 | 1.21 |
| 25 | 1100 | 18 | 550 | 580 | 538 | 610 | 0.76 |
| 26 | 1100 | 16 | 550 | 580 | 535 | 640 | 0.74 |
| 27 | 1100 | 15 | 550 | 580 | 540 | 652 | 0.74 |
| 28 | 1100 | 18 | 550 | 580 | 480 | 580 | 1.22 |
| 29 | 1240 | 18 | 450 | 550 | 710 | 820 | 0.31 |
| 30 | 1100 | 15 | 550 | 580 | 510 | 612 | 0.72 |
| 31 | 1220 | 18 | 480 | 560 | 700 | 815 | 0.33 |
| 32 | 1200 | 20 | 400 | 550 | 620 | 715 | 0.015 |

In Test No. 32, in which the Se content was above the upper limit prescribed according to the invention, the minimum critical CTOD value was markedly lower as compared with other test materials.

In Test Nos. 24–31, in which the Se content was within the range prescribed by the invention but the content of some other element than Se was outside the range prescribed by the invention, the CTOD toughness or strength was poor.

In Test Nos. 19–23, in which the chemical composition was within the range specified by the invention but the production conditions were not appropriate, the CTOD toughness or strength was slightly inferior.

In Test Nos. 1–18, in which the chemical composition and Pcm satisfied the requirements of the present invention and the production conditions were appropriate, the strength was high and the CTOD toughness was good.

Second Embodiment

Steels having the composition specified in Table 2 were melted in a converter and 300-mm-thick slabs were produced therefrom by continuous casting.

TABLE 2

| | Chemical composition (mass %; balance: Fe and other incidental impurities) | | | | | | | | | | | | | | | | |
|---|---|---|---|---|---|---|---|---|---|---|---|---|---|---|---|---|---|
| Steel | C | Si | Mn | P | S | Cu | Ni | Cr | Mo | Nb | V | Ti | Al | N | Se | Other | Pcm |
| A | 0.04 | 0.09 | 1.42 | 0.007 | 0.001 | 0.99 | 0.48 | 0.08 | 0.22 | 0.009 | — | 0.011 | 0.006 | 0.0038 | <0.001 | — | 0.19 |
| B | 0.04 | 0.05 | 1.95 | 0.005 | 0.001 | 1.12 | 0.62 | — | — | — | — | 0.028 | 0.012 | 0.0028 | <0.001 | — | 0.21 |
| C | 0.03 | — | 0.92 | 0.019 | 0.001 | 1.01 | 0.61 | 0.97 | 0.12 | 0.012 | — | 0.013 | 0.021 | 0.0025 | <0.001 | — | 0.19 |
| D | 0.07 | 0.23 | 0.31 | 0.011 | 0.004 | 1.05 | 0.75 | 0.12 | 0.22 | 0.039 | 0.051 | 0.004 | 0.023 | 0.0036 | <0.001 | Ca:0.0026 | 0.18 |
| E | 0.04 | 0.11 | 1.51 | 0.009 | 0.002 | 0.98 | 1.01 | 0.21 | 0.21 | 0.011 | — | 0.011 | 0.005 | 0.0033 | <0.001 | — | 0.21 |
| F | 0.04 | 0.08 | 0.86 | 0.008 | 0.001 | 0.65 | 3.96 | 0.13 | 0.12 | 0.023 | 0.046 | 0.014 | 0.096 | 0.0039 | <0.001 | — | 0.20 |
| G | 0.05 | 0.13 | 0.82 | 0.009 | 0.002 | 1.93 | 1.03 | — | — | — | — | 0.008 | — | 0.0056 | <0.001 | — | 0.21 |
| H | 0.04 | 0.15 | 0.86 | 0.006 | 0.001 | 0.85 | 0.51 | — | 0.96 | — | — | 0.015 | 0.013 | 0.0012 | <0.001 | — | 0.20 |
| I | 0.03 | 0.12 | 0.35 | 0.011 | 0.001 | 0.21 | 0.32 | 0.11 | 0.23 | — | 0.041 | 0.012 | 0.011 | 0.0034 | <0.001 | — | 0.09 |
| J | 0.04 | 0.06 | 0.31 | 0.012 | 0.002 | 2.98 | 0.11 | — | — | 0.012 | — | 0.011 | 0.014 | 0.0022 | <0.001 | — | 0.21 |
| K | 0.03 | 0.06 | 0.54 | 0.011 | 0.001 | 0.61 | 0.31 | — | 1.8 | 0.018 | — | 0.009 | 0.011 | 0.0027 | <0.001 | — | 0.21 |
| L | 0.12 | 0.36 | 1.89 | 0.009 | 0.002 | 1.11 | 0.65 | 0.11 | 0.13 | 0.021 | 0.038 | 0.021 | 0.023 | 0.0031 | <0.001 | — | 0.31 |
| M | 0.06 | 0.23 | 1.42 | 0.009 | 0.001 | 1.02 | 0.56 | — | 0.12 | 0.025 | — | 0.013 | 0.012 | 0.0023 | 0.026 | — | 0.21 |

The slabs were heated to 1150° C. and hot-rolled under various conditions shown in Table 3 with reduction rates of not less than 2 at 900° C. or below, and then cooled to give steel plates having a width of 2000 mm and varying in thickness.

The steel plates as rolled were measured for tensile strength. Further, for each steel, the ordinary temperature tensile strength values to be obtained upon various tempering procedures and strain-removing heat treatment comprising the above steps (I) to (IV) were estimated by calculation using the above equations (2) and (3), and the absolute values (estimated values) of the changes in tensile strength in the process of the above strain-removing heat treatment were calculated.

The constants in the equations (2) and (3) were given the following values: $Q_1$=140 kJ/mol, $Q_2$=244 kJ/mol, $Q_3$=285 kJ/mol, M=82.5 MPa, $A_1=5\times10^5$, $A_2=1\times10^{11}$, $A_3=5\times10^{11}$, B=5.65, and C=1.

The above as-rolled steel plates were tempered by heating to one of temperatures at 50° C. intervals within the range of not lower than 500° C. to not higher than 650° C. over a temperature raising time of 1 hour, maintaining at that temperature for 1 hour and then cooling to ordinary temperature over a temperature lowering time of 1 hour, to give product steel plates.

A large number of test specimens were cut out from each product steel plate, and subjected to heat treatment by heating from ordinary temperature to 580° C. at a rate of 55° C./hour, maintaining at that temperature for a period selected at 15-minute intervals within the range of not short than 15 minutes but not longer than 4 hours and cooling rapidly to room temperature.

Steel plates subjected to the above-mentioned strain-removing heat treatment were also prepared by raising the temperature from ordinary temperature to 580° C., maintaining at 580° C. for 4 hours, then lowering the temperature from 580° C. to 400° C. at a rate of 55° C./hour and thereafter rapidly cooling to room temperature.

No. 4 tensile test specimens prescribed in JIS Z 2201 were taken with the plate width direction as the longitudinal direction of specimens from middle portion, with respect to the plate thickness, of each steel plate after the above heat treatment and measured for tensile strength at ordinary temperature and, in this way, the absolute values (actually measure values) of the changes in tensile strength in the process of the above strain-removing heat treatment were examined.

The hot workability was evaluated based on the occurrence or nonoccurrence of surface cracking as judged by visual observation of the surface of each tempered product steel plate.

Further, No. 4 tensile test specimens prescribed in JIS Z 2201 with the plate width direction taken as the longitudinal direction thereof as well as No. 4 Charpy test specimens prescribed in JIS Z 2202 were taken from the middle portion, with respect to the plate thickness, of each steel plate and examined for tensile test characteristics and impact test characteristics.

Further, a y-groove weld cracking test was conducted according to JIS Z 3158 to evaluate each steel plate for susceptibility to weld cracking. The weld cracking test was carried out in an atmosphere at a temperature of 25° C. and a humidity of 60% at a test specimen initial temperature of 25° C.

The results of various tests are summarized in Table 3.

TABLE 3

| Test No. | Steel | Hot rolling: Finish temp. (° C.) | Hot rolling: Finish thickness (° C.) | Cooling after hot rolling: Initial temp (° C.) | Cooling after hot rolling: Cooling rate *1 (° C./sec) | Cooling after hot rolling: Finish temp. (° C.) | Tempering temp. (° C.) | Change in tensile strength upon strain-removing heat treatment (estimated) (MPa) | Surface cracking during hot working *2 | Product steel plate characteristics: YS (MPa) | Product steel plate characteristics: TS (MPa) | Product steel plate characteristics: vE-40 (J) | Change in tensile strength upon strain-removing heat treatment (actually measured) (MPa) | y cracking *2 |
|---|---|---|---|---|---|---|---|---|---|---|---|---|---|---|
| 51 | A | 820 | 100 | 770 | 3.8 | 340 | 600 | 31 | ○ | 542 | 620 | 294 | 36 | 602 |
| 52 | A | 820 | 100 | 770 | 3.7 | 340 | 650 | 3 | ○ | 545 | 621 | 294 | 13 | ○ |
| 53 | B | 770 | 100 | 730 | 3.7 | 350 | 600 | 31 | ○ | 599 | 662 | 294 | 26 | ○ |
| 54 | C | 820 | 75 | 770 | 4.8 | 350 | 600 | 31 | ○ | 650 | 682 | 102 | 29 | ○ |
| 55 | D | 780 | 50 | 760 | 7.2 | 480 | 600 | 31 | ○ | 540 | 629 | 294 | 33 | ○ |
| 56 | E | 780 | 50 | 760 | 7.2 | 480 | 600 | 31 | ○ | 637 | 694 | 256 | 25 | ○ |
| 57 | F | 820 | 75 | 770 | 4.9 | 360 | 600 | 31 | ○ | 674 | 733 | 294 | 10 | ○ |
| 58 | G | 790 | 50 | 760 | 7.3 | 490 | 650 | 3 | ○ | 501 | 594 | 282 | 5 | ○ |
| 59 | H | 760 | 100 | 720 | 3.5 | 330 | 650 | 3 | ○ | 833 | 860 | 152 | 4 | ○ |
| 60 | I | 770 | 100 | 730 | 3.7 | 340 | 650 | 3 | ○ | 442 | 470 | 235 | 6 | ○ |
| 61 | J | 780 | 50 | 760 | 7.3 | 490 | 650 | 3 | x | 589 | 659 | 168 | 4 | ○ |
| 62 | K | 780 | 50 | 750 | 7.1 | 470 | 600 | 31 | ○ | 821 | 856 | 23 | 22 | ○ |
| 63 | L | 820 | 25 | — | AC | — | 600 | 31 | ○ | 543 | 576 | 294 | 28 | x |
| 64 | M | 820 | 75 | 770 | 4.8 | 360 | 650 | 3 | ○ | 586 | 664 | 41 | 6 | ○ |
| 65 | A | 770 | 100 | — | AC | — | — | 73 | ○ | 356 | 516 | 244 | 82 | ○ |
| 66 | A | 820 | 100 | 770 | 3.6 | 490 | 500 | 66 | ○ | 550 | 639 | 161 | 63 | ○ |
| 67 | A | 770 | 100 | — | AC | — | 550 | 65 | ○ | 494 | 599 | 245 | 58 | ○ |

Note 1: In the "cooling rate" column, AC stands for air cooling.
Note 2: ○ denotes no cracking; x denotes occurrence of cracking As shown in Table 3, the steel plates of Test Nos. 51–59 showed no surface crack and had a tensile strength of not lower than 480 MPa and a Charpy absorbed energy of not less than 50 J at −40° C. and thus showed good characteristics such that no cracking occurred in the y-groove weld cracking test. They each also showed good characteristics as evidenced by a change (actually measured value) in tensile strength of not greater than 50 MPa (in absolute value) during the above strain-removing heat treatment and by stable material characteristics after welding. The estimated values and actually measured values of changes in tensile strength in the process of the above strain-removing heat treatment were in good agreement with each other and, thus, the precision of tensile strength estimation by the equations (2) and (3) was good.

On the contrary, in Test No. 60, in which steel I insufficient in Cu content was used, the steel was insufficient in strength. In Test No. 61, in which steel J excessive in Cu content was used, surface cracks were formed during hot rolling. In Test No. 62, in which steel K excessive in Mo content was used, the toughness of the product steel plate was insufficient. In Test No. 63, in which steel L having an excessively high Pcm value was used, cracks appeared in the y-groove weld cracking test and, in Test No. 64, in which steel M containing a large amount of the incidental impurity Se was used, the toughness of the product steel plate was poor.

With steel A, the change in tensile strength of the product steel plate in the process of the above strain-removing heat treatment was not more than 50 MPa and the stability of the material characteristics against heat treatment after welding was good in Test No. 51, in which the tempering temperature was 600° C., and in Test No. 52, in which the tempering temperature was 650° C., but, in Test No. 65, in which no tempering was performed, and in Test Nos. 66 and 67, in which the tempering temperature was 500° C. or 550° C., the tensile strength change in the process of the above strain-removing heat treatment exceeded 50 MPa, hence the stability was not good.

What is claimed is:

1. A Cu precipitation strengthened steel which comprises, on the mass percent basis, C: 0.02–0.10%, Mn: 0.3–2.5%, Cu: 0.5–2.0%, Ni: 0.3–4.0% and Ti: 0.004–0.03% and further comprises Si: 0.01–0.4% and/or Al: 0.001–0.1%, with the contents of incidental impurities being P: not more than 0.025%, S: not more than 0.01%, N: not more than 0.006% and Se: not more than 0.005%, with the value of Pcm defined by the formula (1) given below being not more than 0.28:

$$Pcm = C + \frac{Si}{30} + \frac{Mn}{20} + \frac{Cu}{20} + \frac{Ni}{60} + \frac{Cr}{20} + \frac{Mo}{15} + \frac{V}{10} + 5B \quad (1)$$

where C, Si, Mn, Cu, Ni, Cr, Mo, V and B respectively represent the contents (in mass percent) of the respective elements.

2. A Cu precipitation strengthened steel as claimed in claim 1 which further comprises, on the mass percent basis, at least one element selected from the group consisting of Cr: 0.05–1.0%, Mo: 0.05–1.0%, Nb: 0.005–0.04%, V: 0.01–0.10% and B: 0.0005–0.003%.

3. A Cu precipitation strengthened steel as claimed in claim 1 which further comprises, on the mass percent basis, at least one element selected from the group consisting of Ca: 0.0005–0.05%, Zr: 0.0005–0.05% and REMs: 0.0005–0.05%.

4. A Cu precipitation strengthened steel as claimed in claim 2 which further comprises, on the mass percent basis, at least one element selected from the group consisting of Ca: 0.0005–0.05%, Zr: 0.0005–0.05% and REMs: 0.0005–0.05%.

5. A Cu precipitation strengthened steel as claimed in claim 1, wherein the content of Se is not more than 0.001%.

6. A Cu precipitation strengthened steel as claimed in claim 5 which further comprises, on the mass percent basis, at least one element selected from the group consisting of Cr: 0.05–1.0%, Mo: 0.05–1.0%, Nb: 0.005–0.04%, V: 0.01–0.10% and B: 0.0005–0.003%.

7. A Cu precipitation strengthened steel as claimed in claim 5 which further comprises, on the mass percent basis, at least one element selected from the group consisting of Ca: 0.0005–0.05%, Zr: 0.0005–0.05% and REMs: 0.0005–0.05%.

8. A Cu precipitation strengthened steel as claimed in claim 6 which further comprises, on the mass percent basis, at least one element selected from the group consisting of Ca: 0.0005–0.05%, Zr: 0.0005–0.05% and REMs: 0.0005–0.05%.

* * * * *